US009177541B2

(12) United States Patent
Ganeshkumar

(10) Patent No.: US 9,177,541 B2
(45) Date of Patent: Nov. 3, 2015

(54) INSTABILITY DETECTION AND CORRECTION IN SINUSOIDAL ACTIVE NOISE REDUCTION SYSTEM

(71) Applicant: Bose Corporation, Framingham, MA (US)

(72) Inventor: Alaganandan Ganeshkumar, North Attleboro, MA (US)

(73) Assignee: Bose Corporation, Framingham, MA (US)

( * ) Notice: Subject to any disclaimer, the term of this patent is extended or adjusted under 35 U.S.C. 154(b) by 217 days.

(21) Appl. No.: 13/973,472

(22) Filed: Aug. 22, 2013

(65) Prior Publication Data

US 2015/0055787 A1 Feb. 26, 2015

(51) Int. Cl.
*G10K 11/00* (2006.01)
*G10K 11/178* (2006.01)

(52) U.S. Cl.
CPC ..... *G10K 11/002* (2013.01); *G10K 11/178* (2013.01); *G10K 2210/1282* (2013.01); *G10K 2210/3028* (2013.01); *G10K 2210/3032* (2013.01); *G10K 2210/3055* (2013.01); *G10K 2210/503* (2013.01)

(58) Field of Classification Search
None
See application file for complete search history.

(56) References Cited

U.S. PATENT DOCUMENTS

| | | | | |
|---|---|---|---|---|
| 5,809,152 | A | 9/1998 | Nakamura et al. | |
| 6,216,047 | B1 | 4/2001 | Goto | |
| 8,194,873 | B2 | 6/2012 | Pan et al. | |
| 8,306,240 | B2 | 11/2012 | Pan et al. | |
| 8,335,318 | B2 | 12/2012 | Pan | |
| 2010/0098265 | A1 * | 4/2010 | Pan et al. | 381/94.1 |

OTHER PUBLICATIONS

The International Search Report and the Written Opinion of the International Searching Authority mailed on Nov. 17, 2014 for corresponding PCT Application No. PCT/US2014/050682.

* cited by examiner

*Primary Examiner* — Paul Huber
(74) *Attorney, Agent, or Firm* — Brian M. Dingman; Dingman, McInnes & McLane, LLP

(57) ABSTRACT

A method for operating an active noise reduction system that is designed to reduce the harmonic or sinusoidal noise emanating from a rotating device, where there is an active noise reduction system input signal that is related to the frequency of the noise to be reduced, and where the active noise reduction system comprises one or more adaptive filters that output a generally sinusoidal noise reduction signal that is used to drive one or more transducers with their outputs directed to reduce the noise. Distortions of the noise reduction signal are detected. A distortion is based at least in part on differences between the frequency of the noise reduction signal and the frequency of the harmonic noise. The noise reduction signal is altered based on the detected distortion.

17 Claims, 4 Drawing Sheets

INSTABILITY DETECTION AND CORRECTION IN SINUSOIDAL ACTIVE NOISE REDUCTION SYSTEM

FIELD

This disclosure relates to the active cancellation of sinusoidal noise.

BACKGROUND

Sinusoidal noise cancellation systems are active noise reduction systems that are used to reduce or cancel one or more sinusoidal noise components. Sinusoidal noise cancellation systems use one or more error microphones as input transducers. A reference signal related to the noise to be canceled (e.g., a sinusoid having a frequency component related to the rotation rate of the device that creates the noise) is inputted to an adaptive filter. The output of the adaptive filter is applied to one or more transducers that produce sound (i.e., loudspeakers). In order to cancel the sinusoidal noise the output of the loudspeaker needs to be of equal magnitude and frequency but opposite phase to the sinusoidal noise at the error microphone location. The adaptive filter can alter the magnitude and/or the frequency of the reference signal with the aim of converging the output to the sinusoidal noise at the error microphone so as to reduce the microphone signal to zero. The adaptive filter adaptively adjusts its internal filter coefficients so as to develop an output signal that is calculated to cancel the sinusoidal noise. The aim of the system is to cancel the microphone signal at the frequency or frequencies of interest.

Sinusoidal noise cancellation systems can be used in any situation in which it is desirable to cancel sinusoidal noise produced by rotating devices. Some applications include motor vehicles, where the systems are used to reduce or cancel sinusoidal (e.g., harmonic) noise in the vehicle cabin. The sources of noise can include the engine and the propeller (prop) shaft, which produce harmonics that can be desirable to cancel. Sources of sinusoidal noise in motor vehicles also include other rotating devices such as the air conditioning compressor or the tires.

In certain situations these sinusoidal noise cancellation systems can become unstable and allow the loudspeaker sound output levels that are designed to cancel the sinusoidal noise to diverge. Such an unstable sinusoidal noise cancellation system can produce loud and noticeable noise artifacts. One cause of such instability can be a change in the loudspeaker to error microphone transfer function(s).

SUMMARY

The first step in correcting instabilities such as divergence of a sinusoidal noise cancellation system for rotating devices (such as the engine and the prop shaft in a motor vehicle) is to detect the problem before it causes audible artifacts. Detecting and correcting an instability before it becomes audible makes the noise cancellation system better able to respond in a manner that is acceptable to the people who are exposed to the noise. Divergence can be detected by comparing the output frequency of the sinusoidal noise cancellation system's adaptive filter to the frequency that is being cancelled. The comparison can in one non-limiting example be based on monitoring the zero crossing rate of the active noise cancellation system output signal.

All examples and features mentioned below can be combined in any technically possible way.

In one aspect, a method for operating an active noise reduction system that is designed to reduce sinusoidal noise emanating from a rotating device, where there is an active noise reduction system input signal that is related to the frequency of the sinusoidal noise to be reduced, and where the active noise reduction system comprises one or more adaptive filters that output a generally sinusoidal noise reduction signal that is used to drive one or more transducers with their outputs directed to reduce the sinusoidal noise, includes detecting distortions of the noise reduction signal, where a distortion is based at least in part on differences between the frequency of the noise reduction signal and the frequency of the sinusoidal noise, and altering the noise reduction signal based on the detected distortions.

Embodiments may include one of the following features, or any combination thereof. Distortions may be detected by comparing the zero crossing rate of the noise reduction signal to the zero crossing rate of the sinusoidal noise. The zero crossing rates may be compared in a window of time. The time period of the window may be variable. The variation of the window period may be based at least in part on the frequency to be reduced.

Other embodiments may include one of the following features, or any combination thereof. An adaptive filter may use coefficients that are based on one or more adaptive filter parameters to modify one or more of the amplitude and phase of the input signal. The step of altering the noise reduction signal based on the detected distortions may comprise altering the values of one or more of the adaptive filter parameters. The adaptive filter parameters may include a leakage factor and an adaptation rate. In this case, and where the active noise reduction system outputs separate noise reduction signals for each of a plurality of transducers, the amount by which one or both of the leakage factor and the adaptation rate are altered may be based on one or more of: i) the scale of the difference between the zero crossing rate of the noise reduction signal and the zero crossing rate of the sinusoidal noise; ii) a difference between the zero crossing rate of the noise reduction signal and the zero crossing rate of the sinusoidal noise coupled with a relatively large noise reduction signal amplitude; and iii) detected distortions in more than one noise reduction signal.

Other embodiments may include one of the following features, or any combination thereof. Altering the values of the one or more adaptive filter parameters may comprise automatically modifying (e.g., reducing) the value of one or more of the adaptive filter parameters. The method may further comprise establishing minimum values of one or more of the adaptive filter parameters and maintaining the values at least at such minimums. The method may further comprise automatically restoring (e.g., increasing) the values of one or more adaptive filter parameters after they have been modified. The values of the one or more adaptive filter parameters may be restored (e.g., increased) in steps. The step size may be related to the difference between the current rate of rotation of the rotating device and the rotation rate when the values of the adaptive filter parameters were modified. The rate of restoration of the values of the one or more adaptive filter parameters after they have been modified may be related to the difference between the current rate of rotation of the rotating device and the rotation rate when the values of the adaptive filter parameters were modified.

Other embodiments may include one of the following features, or any combination thereof. The rotating device may in one example be the engine in a motor vehicle, and the method may further include comparing the amplitude of the noise reduction signal to a reference adaptive filter output signal amplitude that is effective to cancel sinusoidal noise at maximum engine load. The method may also further include estimating the amplitude of the sinusoidal noise based on the engine load, and varying the reference level so it dynamically matches the current engine operating level.

In another aspect, a method for operating an active noise reduction system that is designed to reduce in a motor vehicle cabin harmonic noise emanating from the engine or propeller shaft of the motor vehicle, where there is an active noise reduction system input signal that is related to the frequency of the harmonic noise to be reduced, and where the active noise reduction system comprises one or more adaptive filters that output a generally sinusoidal noise reduction signal that is used to drive one or more transducers with their outputs directed to reduce the harmonic noise, wherein an adaptive filter uses coefficients that are based on one or more of the leakage factor and the adaptation rate of the adaptive filter to modify one or more of the amplitude and phase of the input signal, includes detecting distortions of the noise reduction signal, where a distortion is based at least in part on differences between the frequency of the noise reduction signal and the frequency of the harmonic noise, and where distortions are detected by comparing the zero crossing rate of the noise reduction signal to the zero crossing rate of the harmonic noise, and altering the values of one or more of the leakage factor and the adaptation rate of the adaptive filter based on the detected distortions, to alter the noise reduction signal. The zero crossing rates may be compared in a window of time, where the time period of the window is variable and is based on the frequency to be reduced.

BRIEF DESCRIPTION OF THE DRAWINGS

FIG. 5 is another plot of harmonic energy versus frequency for a baseline harmonic noise with the active noise cancellation system turned off, the noise with the active noise cancellation system turned on and with the active noise cancellation system on and the distortion countermeasures on.

DETAILED DESCRIPTION

Figure 1:
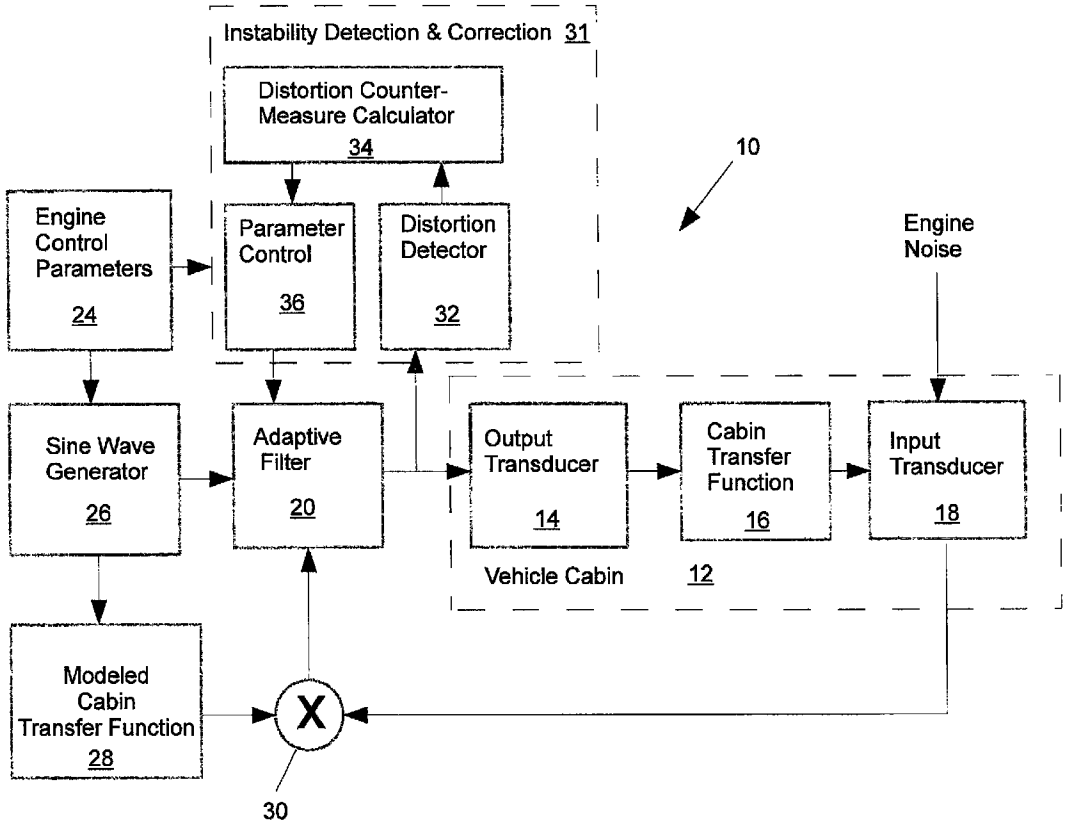
FIG. 1 is a schematic block diagram of a motor vehicle engine harmonic cancellation system.

Elements of FIG. 1 of the drawings are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. For example, a programmed digital signal processor (DSP) may accomplish many functions of the active noise cancellation system described here. The steps of processes may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawings.

Non-limiting examples of manners in which the innovation can operate are illustrated with reference to the drawings. FIG. 1 is a simplified schematic diagram of a motor vehicle engine active harmonic (or sinusoidal) noise cancellation ("ANC") or active noise reduction system 10 that embodies the disclosed innovation. FIG. 1 illustrates an example of the innovation. However, the innovation is not limited to sinusoidal noise cancellation in motor vehicles. Also, the innovation may be used in systems that are adapted to reduce or cancel sinusoidal noise, which may or may not be harmonic noise. System 10 uses adaptive filter 20 that supplies generally sinusoidal noise reduction signals to one or more output transducers 14 that have their outputs directed into vehicle cabin 12. The output of the transducers, as modified by the cabin transfer function 16, is picked up by an input transducer (e.g., microphone) 18. Engine noise in the vehicle cabin is also picked up by input transducer 18. Existing vehicle engine control parameters 24 are used as input signal(s) to system 10 that are related to the vehicle engine operation. Examples include RPM, torque, accelerator pedal position, and manifold absolute pressure (MAP). Sine wave generator 26 is input with one or more such engine control signals that relate to vehicle engine operation, and from which the engine harmonic(s) to be canceled can be determined. Typically, the engine RPM is the signal used by sine wave generator 26. Sine wave generator 26 provides to adaptive filter 20 a sine wave noise reduction reference signal that is also provided to modeled cabin transfer function 28 to produce a revised reference signal. The revised reference signal and the microphone output signals are multiplied together 30, and provided as an input to adaptive filter 20.

Adaptive filter 20 is typically accomplished with a DSP algorithm that is designed to output a generally sinusoidal noise reduction signal that is used to reduce, and ideally to cancel, a single harmonic noise in a particular volume of the motor vehicle, such as the cabin or the muffler assembly. In order to cancel the harmonic noise the cancellation signal needs to be of equal magnitude and frequency but opposite phase to the harmonic noise signal at the location of input transducer 18. The amplitude of the sinusoid should be bounded and proportional to the noise at the transducer. Adaptive filter 20 has filter coefficients that are used to modify the amplitude and phase of the output noise reduction signal. The coefficients are calculated based on two parameters—the leakage factor and the adaptation rate. The operation of adaptive feed forward filters are well known in the art and are further described in U.S. Pat. No. 8,306,240, the disclosure of which is incorporated herein by reference. In the present non-limiting example the adaptive algorithm is a filtered-x adaptive algorithm. However, this is not a limitation of the innovation as other adaptive algorithms could be used, as would be apparent to those skilled in the technical field.

The operation of adaptive feed-forward harmonic noise cancellation systems is well understood by those skilled in the technical field.

Instability detection and correction functionality 31 can be accomplished in the DSP. Function 31 is inputted with the adaptive filter output and the rotation rate of the rotating device or machinery that is the source of the noise to be cancelled; in this case the input is the engine RPM. Distortion detector function 32 accomplishes a review of the noise reduction signal that is outputted by adaptive filter 20 to transducer 14 and determines if any of the conditions have deviated from the desired frequency, phase and/or amplitude. Any such deviation indicates that the system is not acting as expected or as required to properly converge. Such deviations are sometimes referred to herein as distortions of the noise reduction signal. Distortion detector 32 can be accomplished by DSP control functionality.

One property of an effective noise reduction signal is its frequency, which needs to match the frequency of the sinusoidal noise being cancelled. In the case of engine harmonic noise cancellation, the frequency of the noise can be determined from the engine RPM signal that is received via engine control parameters 24. If the frequency of the noise reduction signal does not match the frequency of the harmonic noise being cancelled then that noise cannot be cancelled. Distortion detector 32 can compare the two frequencies, or signals or values that are related to the frequencies, in order to detect distortion.

One method of detecting adaptive filter output distortion is to monitor the zero crossing rate of the output signal. Since the distortion detector is in this non-limiting example accomplished with DSP code, a digital method of zero crossing detection is employed. However, zero crossing detection is well known in the art and other digital or analog means could be used instead. Since zero crossing detection is well known in the art it will not be described further herein.

Figure 2:
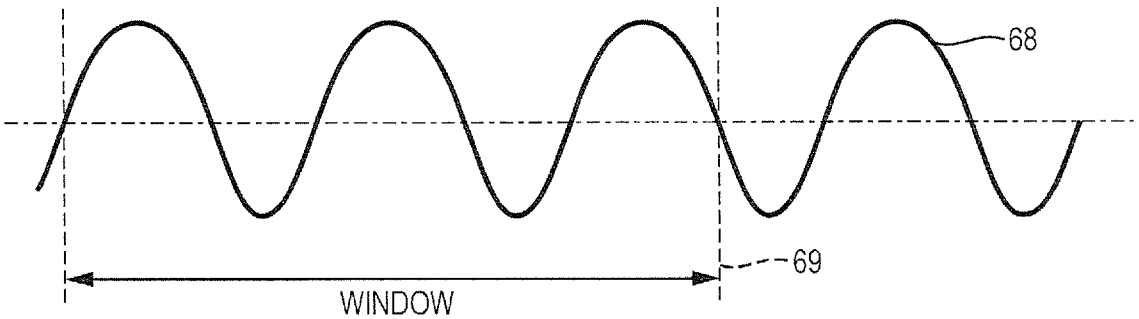
FIG. 2 depicts a noise reduction signal and a window within which the zero crossings of the signal can be determined.

In order for the zero crossing rate detector to monitor the output signal in real time, it is best to monitor the zero crossing rate over a predetermined period of time or "window" of time. FIG. 2 shows a sine wave 68 and a representation of such a window 69. The window should start and stop at a zero crossing. The window period is chosen to provide a balance between the need to detect distortions quickly and the need to allow the noise cancellation system to properly converge during its normal operation. The time span covered by the window can be fixed or can be made variable. If variable, it may be a function of the frequency to be cancelled. So that sufficient data is received over the window period, for example at low frequency since there are fewer zero crossings per second the window period may need to be longer than it needs to be at higher frequencies. The period of the window is best chosen to give the system adequate time to converge in normal operation, but short enough so that divergence can be detected and resolved before unwanted audible sounds (e.g., noise artifacts) are created. While the system is converging the zero crossing rate may not be equal to the expected rate so detecting the zero crossing rate while the system is converging may prematurely trigger countermeasures which in this case might negatively impact the system performance.

The zero crossing rate measured during the window period is compared to the zero crossing rate of the signal from sine wave generator 26 to determine if the zero crossing rate is as expected for that harmonic frequency. Deviations of the measured zero crossing rate from the ideal rate can indicate that the noise cancellation system is having difficulty converging, or that instability has occurred. Reasons that the system may have difficulty converging or may become unstable include issues such as a poor acoustic response in the transfer function path, deviation of the actual transfer function path from the predetermined modeled transfer function estimate used by the adaptive filter, and interference from harmonic energy at frequencies close to the frequency of the noise being canceled (sometimes referred to as the "waterbed-type effect," which is well known in the art). Zero crossing rate deviations determined by distortion detector 32 may thus provide a tool that can be used to indicate problem areas during the tuning of the adaptive filter before it is deployed, and can provide for the monitoring of instability conditions of the noise cancellation system that can in certain circumstances be used as a basis for taking countermeasures to correct the instability. The deviations can also be used as data that can be used to determine if there are larger than expected deviations across the frequency region that could indicate that the particular vehicle model in which the ANC system is being used needs to be re-audited so that the adaptive filter can be re-tuned.

One objective of this disclosure is to detect unstable conditions. Another objective is to prevent the unstable conditions from creating audible noise artifacts. As described above, one indicator of unstable conditions is zero crossing deviation from the ideal. If tight margins are used for such deviation, because zero crossing rates change in normal engine operation relying on the zero crossing rate alone can lead to false indications of distortion. Thus, the performance of the noise cancellation system can be unnecessarily reduced. Since divergence can lead to high speaker output amplitude, high speaker output amplitude can be a secondary measure of distortion. Thus, a slight deviation in zero crossing rate coupled with a high speaker output should be more highly correlated with divergence than a deviation in zero crossing rate alone.

Instability detection and correction functionality 31 can be used to detect a high speaker output level. This can be accomplished by using distortion detector 32 to compare the amplitude of the noise reduction signal to a reference amplitude level. The reference amplitude level would likely be predetermined at the time that the adaptive filter was tuned. For example, the reference amplitude level can be the adaptive filter output signal amplitude (as determined at the time the system was tuned) that is effective to cancel harmonic noise at maximum engine load. Then during operation of the system the amplitude of the noise can be estimated based on the actual engine load, in comparison to the maximum engine load. One or more of the engine control parameters 24, for example a signal such as torque or MAP that represents the engine load, can be used by system 10 to estimate the amplitude of the noise. The adaptive filter output can then be compared with the expected amplitude of the noise to see if there is any distortion due to divergence. For example if the amplitude is significantly larger than the estimated amplitude of the noise, and at the same time there is some deviation in the zero crossing rate, the system can determine that there is divergence.

System 10 can optionally be arranged to initiate steps aimed at correcting detected distortions. In order to correct distortions, system 10 may include means to determine and apply countermeasures that are designed to correct the distortions. This goal can be accomplished by including optional distortion countermeasure calculator functionality 34 that is responsive to distortion detector 32, and optional parameter control functionality 36 that is responsive to countermeasure calculator 34. Functions 34 and 36 together will take the distortions detected by detector 32 and can alter one or more parameters of the adaptive filter that are designed to converge the signal and/or resolve the instability. As an alternative to modifying filter parameters, upon the detection of certain distortions or instabilities the system may be adapted to turn off the noise cancellation function. It can be turned off either until the problem is diagnosed and fixed or until the motor vehicle is turned off and re-started, for example.

It has been found that reducing (i.e., detuning) one or both of the leakage factor and adaptation rate of the adaptive filter may help the output signal zero crossing rate to re-converge. In cases in which distortion is at least in part due to slow convergence, reducing or automatically detuning the adaptation rate and/or the leakage factor can improve the convergence. If the acoustic conditions in the space in which the harmonic noise is being cancelled will not allow such re-convergence, the algorithm parameters will reduce the amplitude of the unstable signal. The reduced amplitude will minimize the impact of the instability on passengers in the motor vehicle. Adjustments other than to adaptation rate and leakage can additionally or alternatively be employed. Examples of other adjustments include temporarily modifying the reference transfer function or perhaps turning certain loudspeakers or microphones off.

The appropriate countermeasure(s) can be triggered when the deviation passes a predetermined threshold, for example a deviation of 5% above or below the expected zero crossing rate. The deviation trigger can be a function of harmonic frequency. The amount of detuning that is accomplished in system 10 can be made proportional to the severity of the distortion that is detected. The severity of the distortion can be weighted based on one or more of the following: a difference between the zero crossing rate of the noise reduction signal and the zero crossing rate of the harmonic noise; a difference between the zero crossing rate of the noise reduction signal and the zero crossing rate of the harmonic noise coupled with a relatively large noise reduction signal amplitude; and the detection of distortions in more than one noise reduction signal (i.e., the output signals for more than one transducer) for the same harmonic.

The amount of detuning can additionally or alternatively be based in part on the rate of change of the revolution rate (e.g., RPM) of the rotating device to help ensure that an appropriate amount of detuning is applied for any given rate of change in rotation rate. This would typically be determined empirically during the tuning process. For example if the +/−5% deviation threshold described above is used and the RPM changes rapidly (e.g., during rapid acceleration) within a detection window such that it causes the zero crossing rate to exceed this threshold one of several options can be employed. Depending on the detected RPM change in the window period, the threshold can be increased from say 5% to say 10%. Or, if the detected RPM change is even more rapid it is unlikely to cause a stability issue as the system is not at one frequency long enough, in which case the parameters could just not be adjusted during such rapid RPM changes. Optionally in the case of such rapid RPM changes, to help the system to re-converge the leakage can be temporarily set to zero during such acceleration. Setting the leakage temporarily to zero will enable the adaptive filter weights to reset, and so the algorithm can start fresh at the new frequency point. This will prevent the distortion detector from prematurely detecting a divergence condition due to incorrect initial non-zero adaptive filter weights.

Reducing the parameters of the adaptive filter too much can eventually lead to a condition in which the system may not produce an output signal with an amplitude that is sufficient to be monitored by the distortion detector accurately for recovery back to convergence or stability. To avoid the detuning measures from reducing the output signal amplitude too far, minimum values can be established for the adaptive filter coefficient parameter(s). In this case, if the parameter values fall to the minimum, system 10 would prevent them from decreasing further. Establishing minimum values for the detuned parameters helps to ensure that there are adequate signal levels that can be detected with distortion detector 32. The detector can be designed such that this adequate signal level results in a loudspeaker output that is inaudible, so that this aspect does not cause unwanted sounds that are audible to the passengers. One result of these countermeasures is that the noise reduction system will not contribute additional noise beyond that presented by the rotating device at the input transducer.

Once the parameter(s) of the adaptive filter have been reduced it is desirable to return them to their normal levels, provided that distortion remains at an acceptable level. Recovery of the parameters should be done in a manner in which noise artifacts are not created. Thus, the return should be taken at a slow enough pace such that any divergence caused by the return will be detected before it becomes problematic. One manner of recovering the parameters is to increase them in a step-wise fashion. So that sufficient data can be analyzed during a window period while this recovery is underway, the step size can be established based on a difference between the current rotation rate of the harmonic noise-producing device and its rotation rate at the time that the parameter(s) were reduced. For example if the parameters were reduced with the engine operating at 2000 RPM and the engine is now operating at 3000 RPM the step size of the parameter correction can be larger than it would be if the current engine speed is only 2100 RPM. If the RPM remains at about the same rate as it was during detuning it is best to use a very small step size as divergence is inherently more likely.

Figure 3:
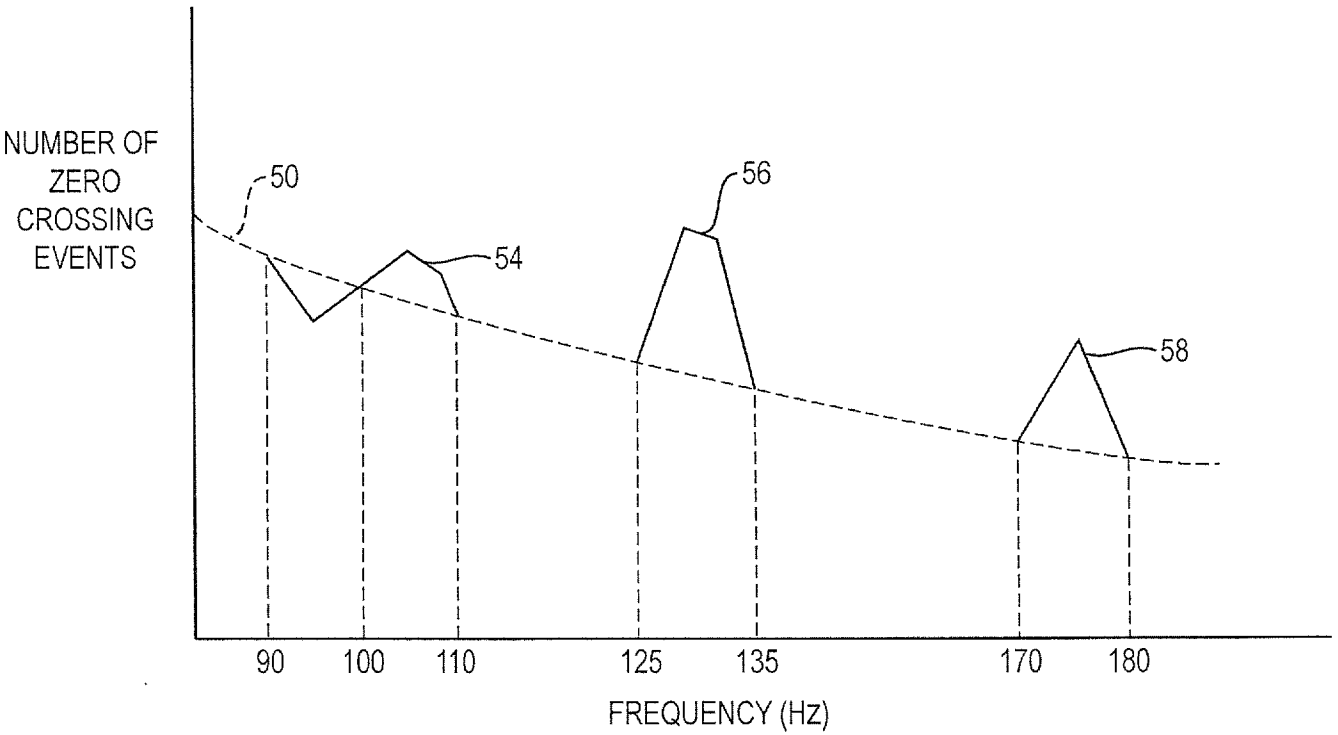
FIG. 3 illustrates an example of zero crossing rate as a function of harmonic frequency.

An idealized example of the zero crossing rate of a noise reduction signal as a function of harmonic frequency is shown in FIG. 3. Smoothly-decreasing curve 50 (dashed line) is an ideal data curve for a dominant $3^{rd}$ order engine harmonic of the output signal for a single loudspeaker. Instabilities are indicated by the solid line excursions from the ideal curve at locations 54, 56 and 58. The instability at location 54 (at 90-110 Hz) is due to a deviation in the transfer function. The instability at location 56 (at 125-135 Hz) is caused by a waterbed-type effect at a $2^{nd}$ order driveline level. The instability at location 58 (at 170-180 Hz) is due to a deviation in the transfer function.

Figure 4:
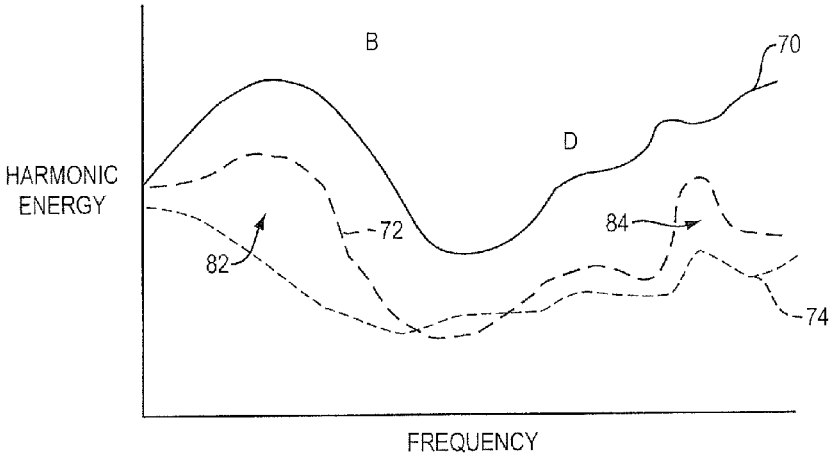
FIG. 4 is a plot of harmonic energy versus frequency for a baseline harmonic noise, the same noise but with an active noise cancellation system turned on (but without the distortion detection and parameter control turned on), and the same active noise cancellation system turned on and with the distortion detection and correction.

FIG. 4 is an idealized plot of harmonic energy versus frequency for a baseline harmonic noise (at the microphone location), curve 70 (solid line curve), the same noise but with an active noise cancellation system as shown in FIG. 1 turned on (but without the distortion detection and parameter control turned on), curve 72 (fine dashed line curve), and the same active noise cancellation system turned on and with the distortion detection and correction, curve 74 (coarser dashed line curve). Area 82, where the harmonic noise is not reduced very much (indicating that the noise cancellation system has poor convergence) corresponds to location 54, FIG. 3 and is the result of a deviation in the transfer function. With the countermeasures turned on, the distortion is reduced (curve 74) and the noise cancellation system effectiveness is improved automatically. Similarly, at location 84 which corresponds to location 58, FIG. 3, the result of the reduction of a deviation in the transfer function is indicated by the difference between curve 72 and curve 74.

Figure 5:
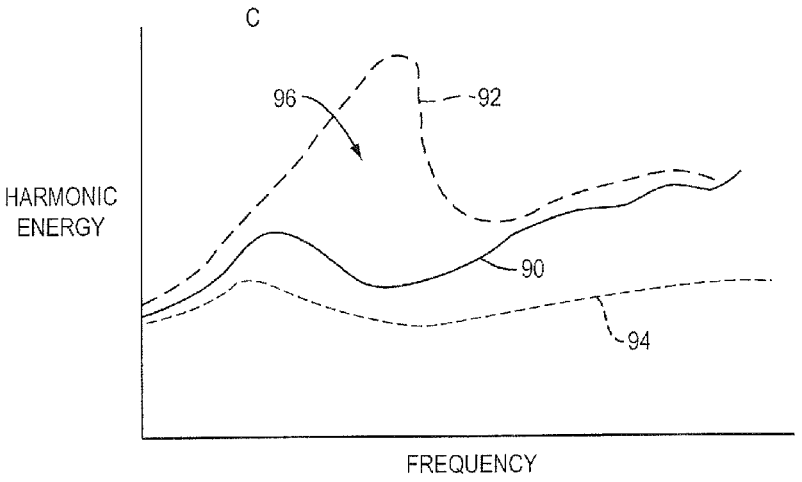

In a similar fashion FIG. 5 is an idealized plot wherein curve 90 (solid line) illustrates a baseline harmonic noise with the ANC system turned off. Curve 92 (fine dashed line) is with the ANC system turned on. Curve 94 (coarser dashed line) is with the ANC system on and the distortion countermeasures turned on. Area 96 illustrates divergence, which may be caused by either a change in the transfer function or possible waterbed-type effect. Taking the countermeasures disclosed herein can converge the filter and return operation back to the expected cancellation level, as illustrated by curve 94.

Those skilled in the art will understand that a zero crossing detector essentially accomplishes detection of frequency deviation from the expected case, and that there are other equally effective methods that could also be used to detect such frequency deviation that are encompassed within the scope of the subject disclosure. A distortion detector is, in a more general sense, a threshold detector that functions as a periodicity estimator. A zero crossing detector is one instantiation of a threshold detector, but this innovation encompasses means of measuring similar periodicity information that could be used instead of a zero crossing detector. One example could be a time-domain autocorrelation calculation.

One result of the subject innovation is that the harmonic cancellation system does not need to be turned off when it begins to diverge. Another benefit is that detectable noise artifacts due to system instability can be eliminated or reduced. A benefit of the countermeasures is that in the worst case no noise beyond the baseline harmonic noise will be produced.

The above was described relative to harmonic noise cancellation in the cabin of a motor vehicle. However, the disclosure applies as well to noise cancellation in other vehicle locations. One additional example is that the system can be designed to cancel noise in a muffler assembly. Also, the noise being cancelled may be engine harmonic noise but may also be other vehicle-operation related noise such as from any other rotating device or structure such as the prop shaft, or a motor (e.g., the air conditioning compressor), or the tires, for example. Also, the active noise reduction does not need to be associated with a motor vehicle. For example active noise reduction can be used in industrial or commercial settings to reduce noise from rotating machinery.

Embodiments of the devices, systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

The various features of the disclosure could be enabled in different manners than those described herein, and could be combined in manners other than those described herein. A number of implementations have been described. Nevertheless, it will be understood that additional modifications may be made without departing from the scope of the inventive concepts described herein, and, accordingly, other embodiments are within the scope of the following claims.

What is claimed is:

1. A method for operating an active noise reduction system that is designed to reduce sinusoidal noise emanating from a rotating device, where there is an active noise reduction system input signal that is related to the frequency of the sinusoidal noise to be reduced, and where the active noise reduction system comprises one or more adaptive filters that output a generally sinusoidal noise reduction signal that is used to drive one or more transducers with their outputs directed to reduce the sinusoidal noise, the method comprising:

detecting distortions of the noise reduction signal by comparing the zero crossing rate of the noise reduction signal to the zero crossing rate of the sinusoidal noise; and altering the noise reduction signal based on the detected distortions.

2. The method of claim 1 wherein the zero crossing rates are compared in a window of time.

3. The method of claim 2 wherein the time period of the window is variable.

4. The method of claim 3 wherein a variation of the window period is based at least in part on the frequency to be cancelled.

5. The method of claim 1 wherein an adaptive filter uses coefficients that are based on one or more adaptive filter parameters to modify one or more of the amplitude and phase of the input signal, and wherein altering the noise reduction signal based on the detected distortions comprises altering the values of one or more adaptive filter parameters.

6. The method of claim 5 wherein the adaptive filter parameters comprise a leakage factor and an adaptation rate.

7. The method of claim 6 wherein the active noise reduction system outputs separate noise reduction signals for each of a plurality of transducers, and where the amount by which one or both of the leakage factor and the adaptation rate are altered is based on one or more of:

i) the scale of the difference between the zero crossing rate of the noise reduction signal and the zero crossing rate of the sinusoidal noise;

ii) a difference between the zero crossing rate of the noise reduction signal and the zero crossing rate of the sinusoidal noise coupled with a relatively large noise reduction signal amplitude; and iii) detected distortions in more than one noise reduction signal.

8. The method of claim 5 wherein altering the values of the one or more adaptive filter parameters comprises automatically reducing the value of one or more of the adaptive filter parameters.

9. The method of claim 8 further comprising establishing minimum values of one or more of the adaptive filter parameters and maintaining the values at least at such minimums.

10. The method of claim 8 further comprising automatically increasing the values of one or more adaptive filter parameters after they have been reduced.

11. The method of claim 10 wherein the values of the one or more adaptive filter parameters are increased in steps.

12. The method of claim 11 wherein the step size is related to the difference between the current rate of rotation of the rotating device and the rotation rate when the values of the adaptive filter parameters were reduced.

13. The method of claim 10 wherein the rate of increase of the values of the one or more adaptive filter parameters after they have been reduced is related to the difference between the current rate of rotation of the rotating device and the rotation rate when the values of the adaptive filter parameters were reduced.

14. The method of claim 1 where the rotating device is the engine in a motor vehicle, and further comprising comparing the amplitude of the noise reduction signal to a reference adaptive filter output signal amplitude that is effective to cancel sinusoidal noise at maximum engine load.

15. The method of claim 14 further comprising estimating the amplitude of the sinusoidal noise based on the engine load, and varying the reference level so it dynamically matches the current engine operating level.

16. A method for operating an active noise reduction system that is designed to reduce in a motor vehicle cabin harmonic noise emanating from the engine or propeller shaft of the motor vehicle, where there is an active noise reduction system input signal that is related to the frequency of the harmonic noise to be reduced, and where the active noise reduction system comprises one or more adaptive filters that output a generally sinusoidal noise reduction signal that is used to drive one or more transducers with their outputs directed to reduce the harmonic noise, wherein an adaptive filter uses coefficients that are based on one or more of the leakage factor and the adaptation rate of the adaptive filter to modify one or more of the amplitude and phase of the input signal, the method comprising:

detecting distortions of the noise reduction signal, where a distortion is based at least in part on differences between the frequency of the noise reduction signal and the frequency of the harmonic noise, and where distortions are detected by comparing the zero crossing rate of the noise reduction signal to the zero crossing rate of the harmonic noise; and altering the values of one or more, of the leakage factor and the adaptation rate of the adaptive filter based on the detected distortions, to alter the noise reduction signal.

17. The method of claim 16 wherein the zero crossing rates are compared in a window of time, where the time period of the window is variable and is based on the frequency to be cancelled.

* * * * *